US005299105A

United States Patent [19]

Arntzen

[11] Patent Number: 5,299,105

[45] Date of Patent: Mar. 29, 1994

[54] BROKEN TAP EXTRACTION TOOL

[76] Inventor: Ronald W. Arntzen, 84 Moore Dr., Ketchikan, Ak. 99901

[21] Appl. No.: 31,097

[22] Filed: Mar. 8, 1993

[51] Int. Cl.[5] ..... B25B 23/18

[52] U.S. Cl. ..... 362/119; 362/32; 81/53.2

[58] Field of Search ..... 29/240; 81/53.2; 362/32, 109, 119, 120

[56] References Cited

U.S. PATENT DOCUMENTS

| | | | |
|---|---|---|---|
| 2,600,924 | 6/1952 | Royer et al. | 81/53.2 |
| 4,389,913 | 6/1983 | Drouin et al. | 81/53.2 |
| 4,831,902 | 5/1989 | McClure | 81/53.2 |
| 5,051,876 | 9/1991 | Norman | 362/120 |

*Primary Examiner*—Stephen F. Husar
*Attorney, Agent, or Firm*—S. Michael Bender

[57] ABSTRACT

A new and improved broken tap extraction apparatus for a broken tap in a material undergoing thread tapping, wherein the broken tap has thread cutting portions and has noncutting portions located between the cutting portions. The broken tap extraction apparatus of the invention includes a head portion adapted to receive a torque applying tool, a shank portion connected to the head portion, and at least two tap engaging portions projecting from the shank portion. The shank portion receives torque applied at the head portion and transmits the torque to the tap engaging portions that project from the shank portion. The tap engaging portions engage the noncutting portions of the tap, such that when torque is applied to the head portion, the torque is transmitted to the tap engaging portions for exerting the torque against the noncutting portions of the broken tap for turning the broken tap out of the material undergoing tapping. In addition, the head portion and the shank portion may include a first internal channel adapted to receive an optical fiber which receives light from a light source. Also, the head portion and the shank portion may include a second internal channel adapted to receive lubricating oil and to convey the received oil toward the broken tap.

7 Claims, 4 Drawing Sheets

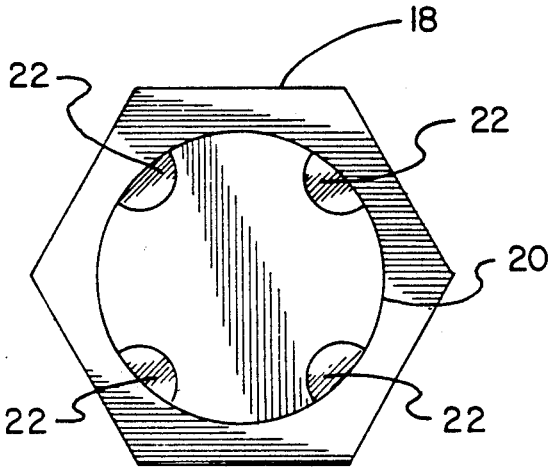
FIG. 2
FIG. 4
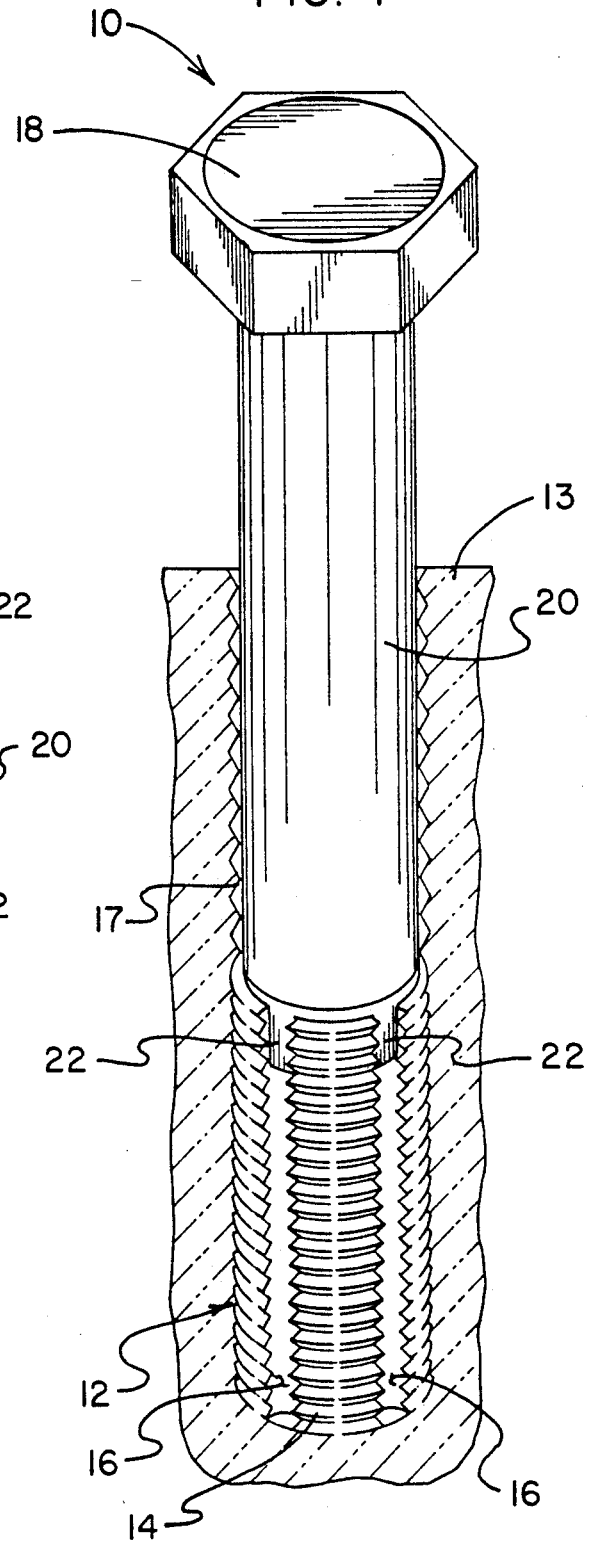

FIG. 5
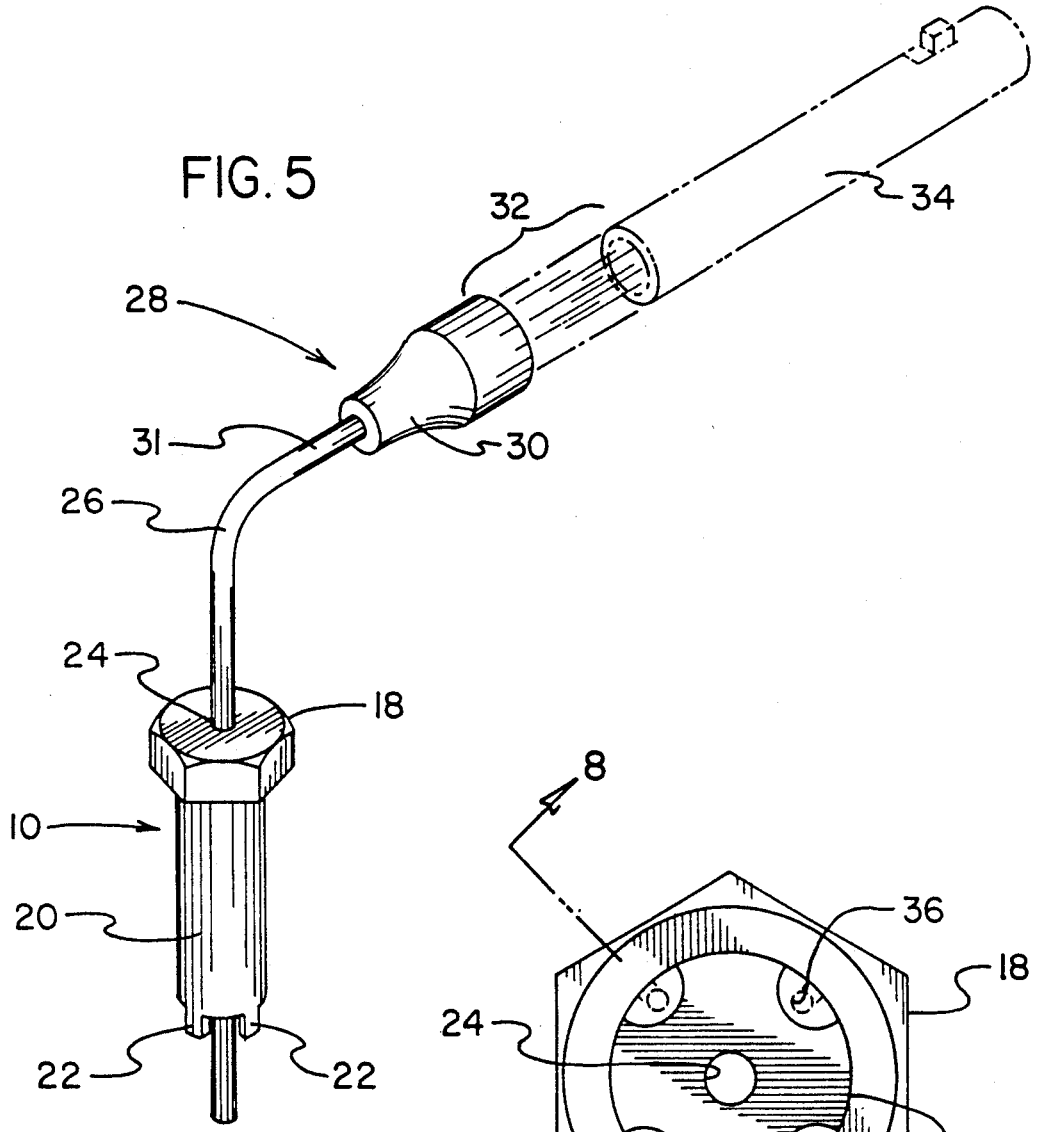
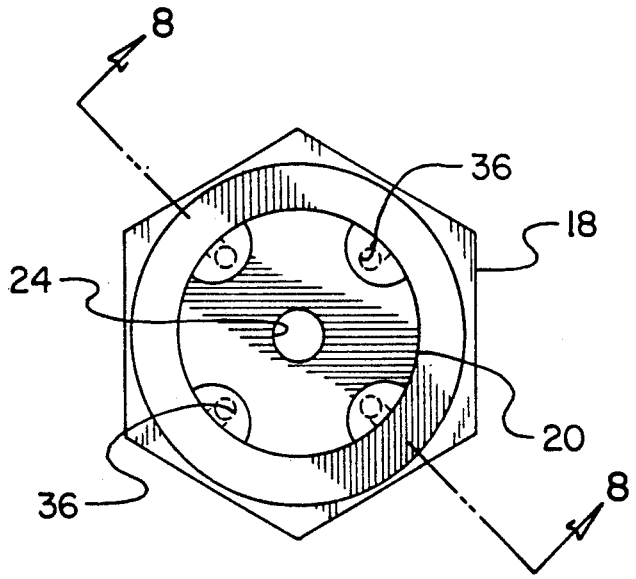
FIG. 7

BROKEN TAP EXTRACTION TOOL

BACKGROUND OF THE INVENTION

1. Field of the Invention

The present invention relates generally to tools designed to remove broken pieces of other tools, and more particularly, to a new tool especially adapted to remove broken taps from materials in which the taps break.

2. Description of the Prior Art

Tools designed to remove or extract a broken piece of another tool are well known in the art. For example, the following U.S. patents are known: U.S. Pat. Nos. 4,078,458 of Berendzen; 4,389,913 of Drouin et al; 4,688,315 of Jannke; and 4,831,902 of McClure. More specifically, the Berendzen, Drouin et al, Jannke, and McClure patents disclose devices designed to remove broken screws from materials in which the screws break. All of these devices require a cutting operation to enable the extraction tool to extract the broken screw. None of the these tools are designed to remove a broken tap from material in which the tap breaks. Moreover, none of these prior art tools are designed to remove the broken other tool without a cutting operation.

More specifically, a tap is designed to cut threads into a material. An exemplary tap is shown in U.S. Pat. No. 4,271,554 of Grenell. A tap has at least two oppositely positioned cutting elements. A tap also has portions which support the cutting elements but which do not effect any cutting themselves. When the tap is rotated in a hole, the rotating cutting elements create a cylindrically tapped hole, and a space is left, adjacent to the non-cutting tap portions, for cut material to deposit. Sometimes, an excessive amount of torque is applied to the tap, and the tap breaks. Removing the broken tap is a difficult problem.

Thus, while the foregoing body of prior art indicates it to be well known to use extraction tools to extract broken screws from a material using a cutting operation, the provision of a simple and cost effective device is not contemplated to remove a broken tap from the material in which the tap breaks. Also, the prior art does not provide first extraction tools that are designed to remove a broken second tool without a cutting operation. The foregoing disadvantages are overcome by the unique broken tap extraction apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a broken tap extraction apparatus for a broken tap in a material undergoing thread tapping, wherein the broken tap has thread cutting portions and has noncutting portions located between the cutting portions. The broken tap extraction apparatus of the invention includes a head portion adapted to receive a torque applying tool, a shank portion connected to the head portion, and at least two tap engaging portions projecting from the shank portion. The shank portion receives torque applied at the head portion and transmits the torque to the tap engaging portions that project from the shank portion. The tap engaging portions engage the noncutting portions of the tap, such that when torque is applied to the head portion, the torque is transmitted through the shank portion to the tap engaging portions for exerting the torque against the noncutting portions of the broken tap for turning the broken tap out of the material undergoing tapping. In addition, the head portion and the shank portion may include a first internal channel adapted to receive an optical fiber which receives light from a light source. Also, the head portion and the shank portion may include a second internal channel adapted to receive lubricating oil and to convey the received oil toward the broken tap.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved broken tap extraction apparatus which has all of the advantages of the prior art and none of the disadvantages.

It is another object of the present invention to provide a new and improved broken tap extraction apparatus which may be easily and efficiently manufactured and marketed.

It is a further object of the present invention to provide a new and improved broken tap extraction apparatus which is of durable and reliable construction.

An even further object of the present invention is to provide a new and improved broken tap extraction apparatus which is susceptible of a low cost of manufacture with regard to both materials and labor, and which accordingly is then susceptible of low prices of sale to the consuming public, thereby making such broken tap extraction apparatus available to the buying public.

Still yet a further object of the present invention is to provide a new and improved broken tap extraction apparatus to remove a broken tap from the material in which the tap breaks.

Still another object of the present invention is to provide a new and improved broken tap extraction apparatus that is designed to remove the broken tool without a cutting operation.

Yet another object of the present invention is to provide a new and improved broken tap extraction apparatus that provides a source of illumination to facilitate viewing the broken tap and positioning the broken tap extraction apparatus of the invention on the broken tap.

Still another object of the present invention is to provide a new and improved broken tap extraction apparatus that provides means for lubricating the broken tap as the broken tap is being turned and extracted from the material undergoing tapping.

These together with still other objects of the invention, along with the various features of novelty which characterize the invention, are pointed out with particularity in the claims annexed to and forming a part of this disclosure. Fo a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 2 is a bottom view of the embodiment of the broken tap extraction apparatus shown in FIG. 1 taken along the line 2—2 thereof.

FIG. 4 is a perspective view of the embodiment of the invention shown in FIG. 1 installed on a broken tap.

FIG. 5 is a perspective view of a second preferred embodiment of the broken tap extraction apparatus of the invention which is adapted to receive an optical fiber.

FIG. 7 is an enlarged bottom view of the embodiment of the invention shown in FIG. 6 taken along the line 7—7 thereof.

DESCRIPTION OF THE PREFERRED EMBODIMENT

Figure 3:
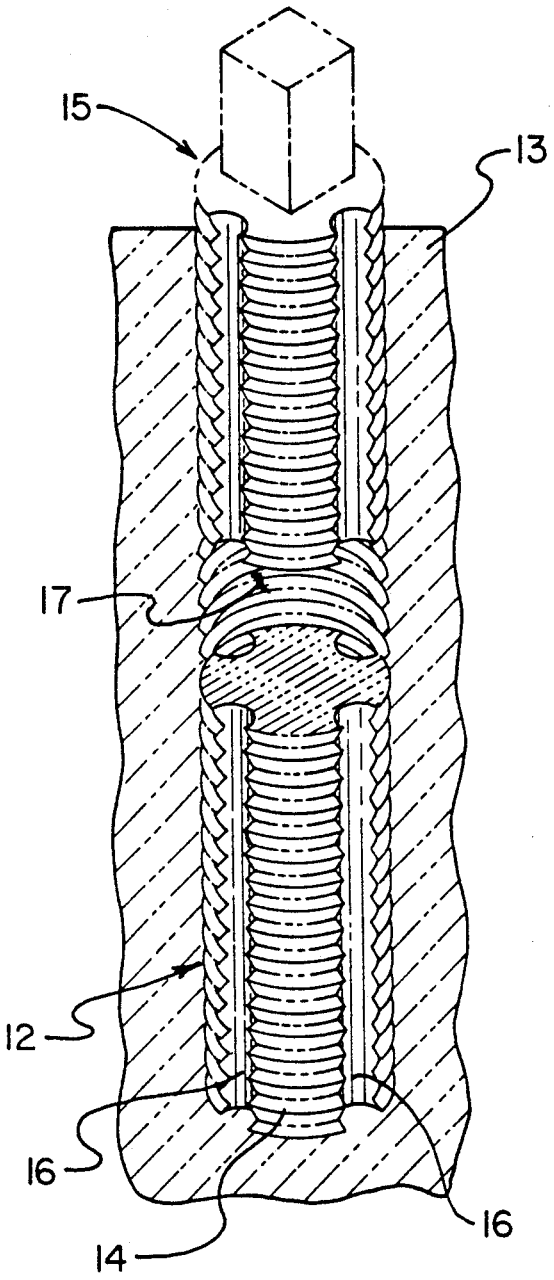
FIG. 3 is a perspective view, partially broken away, of prior art in which a broken tap in present in a material undergoing tapping.
Figure 1:
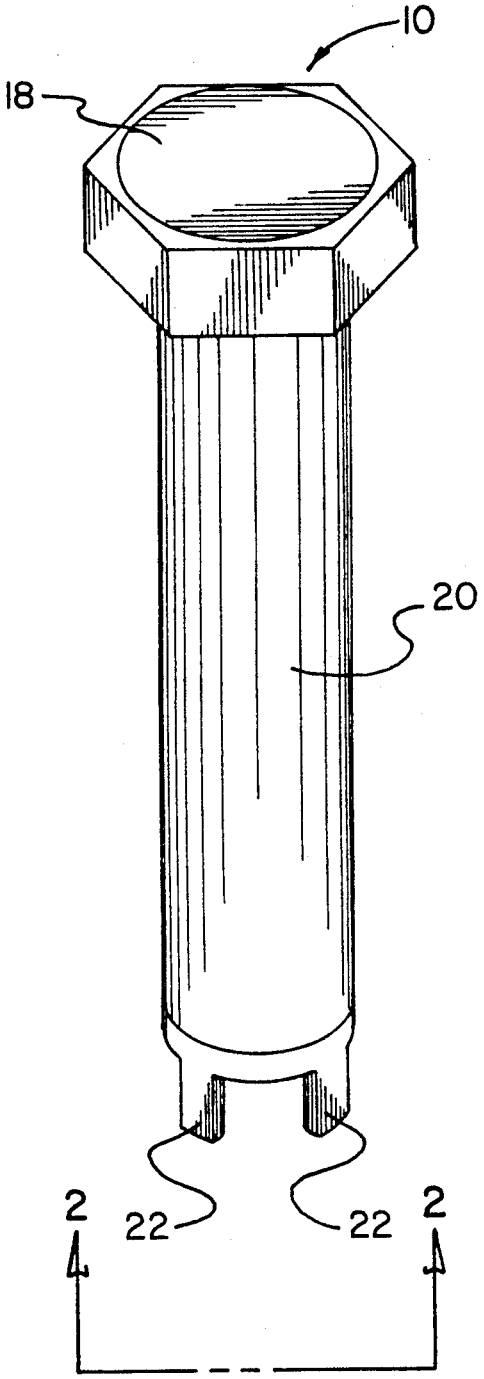
FIG. 1 is a perspective view showing a first preferred embodiment of the broken tap extraction apparatus of the invention.

With reference to the drawings, a new and improved broken tap extraction apparatus embodying the principles and concepts of the present invention will be described.

Turning initially to FIGS. 1–4, there is shown a first exemplary embodiment of the broken tap extraction apparatus of the invention generally designated by reference numeral 10. The broken tap extraction apparatus 10 is designed to remove or extract a broken tap 12 in a material 13 undergoing tapping, wherein the broken tap 12 has thread cutting portions 14 and has noncutting portions 16 located between the cutting portions 14.

In its preferred form, broken tap extraction apparatus 10 a head portion 18 adapted to receive a torque applying tool, such as a socket wrench (not shown). A shank portion 20 is connected to the head portion 18, and the shank portion 20 receives and transmits torque from the head portion 18. Four tap engaging portions 22 project from the shank portion 20. The tap engaging portions 22 engage four noncutting portions 16 of the broken tap 12, such that when torque is applied to the head portion 18, the torque is transmitted through the shank portion 20 to the tap engaging portions 22 for exerting the torque against the noncutting portions 16 of the broken tap 12 for turning the broken tap 12 out of the material 13 undergoing tapping.

To use the broken tap extraction apparatus 10 of the invention, once the tap is broken, the top portion 15 of the broken tap is unscrewed and removed from the hole 17 in the material 13. Then, the broken tap extraction apparatus 10 of the invention is inserted into the hole 17 in the material 13 that the top portion 15 of the tap previously occupied. More specifically, the tap engaging portions 22 are engaged with the noncutting portions 16 of the broken tap 12. A hammer (not shown) may be used to assure a tight fit of the tap engaging portions 22 with the noncutting portions 16. Then, a tool, such as a socket wrench (not shown) is used to apply torque to the head portion 18 and spin the broken tap portion 12 out of the hole 17 along threads that were tapped into the hole 17 before the tap broke.

Turning to FIG. 5, a second embodiment of the broken tap extraction apparatus 10 of the invention is shown. Reference numerals are shown that correspond to like reference numerals that designate like elements shown in the other figures. In addition, in FIG. 5, the head portion 18 and the shank portion 20 include a first internal channel 24 which is adapted to receive a flexible optical fiber 26.

More specifically, an illumination assembly 28 is provided which includes the optical fiber 26, an adaptor 30 which is connected to one end 31 of the optical fiber 26, and a light source 34 which can be fitted to the adaptor 30. The adaptor 30 is adapted to receive light beams 32 from the light source 34 which is shown to be a battery-powered flashlight.

The optical fiber 26 provides a "window" which may be looked through in order to facilitate engagement of the tap engaging portions 22 with the noncutting portions 16. In addition, the use of illumination facilitates observation of the broken tap 12 in the material 13 even under dark conditions, and it permits effective placement of the tap engaging portions 22 for exerting the torque against the noncutting portions 16 of the broken tap 12 for turning the broken tap 12 out of the material 13 undergoing tapping.

Figure 8:
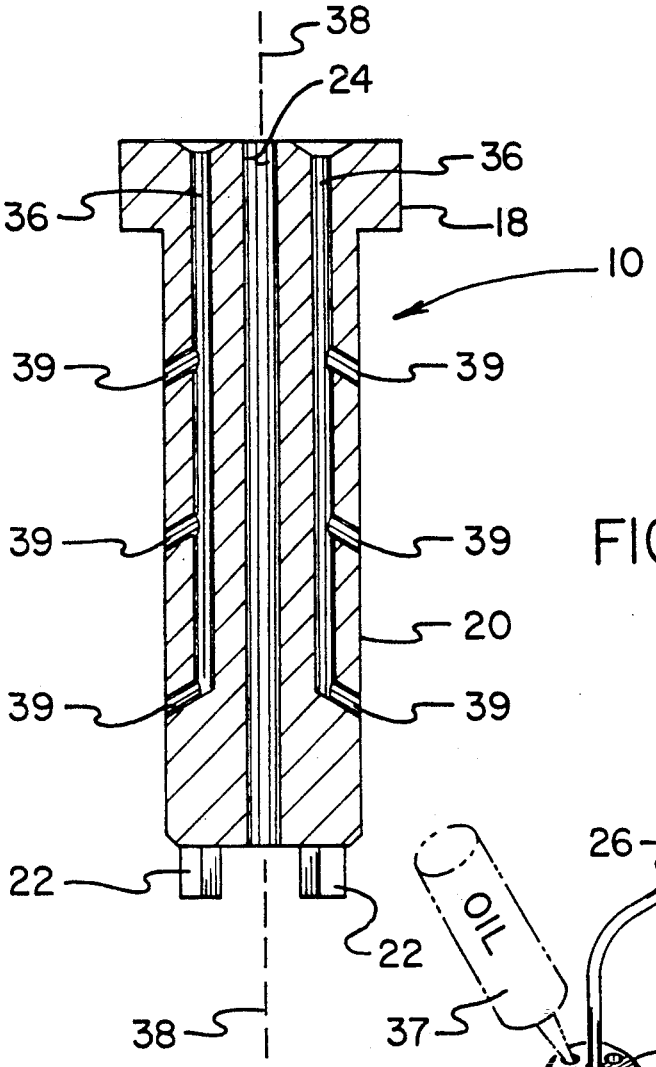
FIG. 8 is a cross-sectional view of the embodiment of the invention shown in FIG. 7 taken along the line 8—8 thereof.
Figure 6:
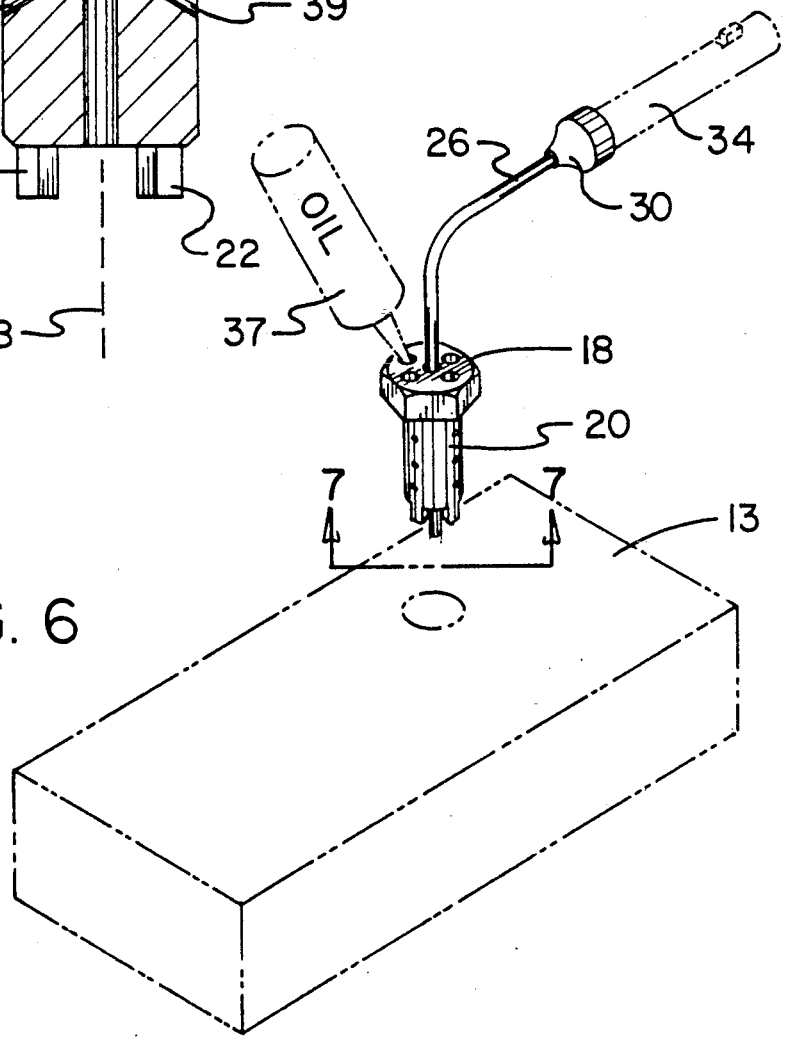
FIG. 6 is a perspective view of a third preferred embodiment of the broken tap extraction apparatus of the invention which is adapted to lubricate the broken tap as it is being removed.

Turning to FIGS. 6–8, a third embodiment of the broken tap extraction apparatus 10 of the invention is shown. Reference numerals are shown that correspond to like reference numerals that designate like elements shown in the other figures. In addition, in FIGS. 6–8, the head portion 18 and the shank portion 20 include a second internal channels 36 adapted to receive oil and to convey the received oil toward the broken tap 12. The oil is supplied by an oil bottle 37. The second internal channels 36 include side branches 39 out of which the oil can flow. The applied oil provides lubrication between the thread cutting portions 14 of the broken tap 12 and the material 13 to facilitate removal of the broken tap 12 from the material 13 with a relatively small amount of applied torque. Without the lubrication, more torque would be needed to be applied to remove the broken tap 12.

As shown in the Figures, the plurality of second internal channels 36 are positioned peripherally with respect to a first internal channel 24 which is positioned along a longitudinal axis 38 which traverses the head portion 18 and the shank portion 20.

The broken tap extraction apparatus 10 of the invention can be fabricated from strong, inexpensive metal material. Holes can be drilled into the apparatus to provide the first and second internal channels.

It is apparent from the above that the present invention accomplishes all of the objects set forth by providing a new and improved broken tap extraction apparatus that is low in cost, relatively simple in design and operation, and which may advantageously be used to remove a broken tap from the material in which the tap breaks without using a cutting operation.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims.

What is claimed as being new and desired to be protected by Letters Patent of the United States is as follows:

1. A new and improved broken tap extraction apparatus for a broken tap in a material undergoing tapping, wherein the broken tap has cutting portions and has noncutting portions located between the cutting portions, said apparatus comprising:

a head portion adapted to receive a torque applying tool, a shank portion connected to said head portion, said shank portion for receiving and transmitting torque from said head portion, at least two tap engaging portions projecting from said shank portion, said tap engaging portions engaging the noncutting portions of the tap, such that when torque is applied to said head portion, the torque is transmitted to said tap engaging portions for exerting the torque against the noncutting portions of the broken tap for turning the broken tap out of the material undergoing tapping.

2. The apparatus described in claim 1 wherein four tap engaging portions project from said shank portion for engaging four noncutting portions of the broken tap.

3. The apparatus described in claim 1 wherein said head portion and said shank portion include a first internal channel.

4. The apparatus described in claim 3 wherein said first internal channel is adapted to receive an optical fiber.

5. The apparatus described in claim 1 wherein said head portion and said shank portion include a first internal channel, and further including an illumination assembly which is comprised of, an optical fiber adapted to be positioned in said first internal channel, and an adaptor, connected to one end of said optical fiber, for receiving light from a light source.

6. The apparatus described in claim 1 wherein said head portion and said shank portion include a second internal channel adapted to receive oil and to convey the received oil toward the broken tap.

7. The apparatus described in claim 1 wherein said head portion and said shank portion include a plurality second internal channels positioned peripherally with respect to a first internal channel which is positioned along a longitudinal axis which traverses said head portion and said shank portion.

* * * * *